United States Patent [19]

Bartesaghi

[11] Patent Number: 4,516,457

[45] Date of Patent: May 14, 1985

[54] PLANE DIE-CUTTING MACHINE

[76] Inventor: Angelo Bartesaghi, Caduti a Fossoli 22, Lecco (Como), Italy

[21] Appl. No.: 601,116

[22] Filed: Apr. 18, 1984

Related U.S. Application Data

[63] Continuation of Ser. No. 348,510, Feb. 12, 1982, abandoned.

[30] Foreign Application Priority Data

Feb. 25, 1981 [IT] Italy ..... 19961 A/81

[51] Int. Cl.[3] ..... B26D 5/16

[52] U.S. Cl. ..... 83/646

[58] Field of Search ..... 83/644, 646, 568, 569, 83/510

[56] References Cited

U.S. PATENT DOCUMENTS

| | | | |
|---|---|---|---|
| 2,130,818 | 9/1938 | Soderberg | 83/646 X |
| 2,737,238 | 3/1956 | Rowlands | 83/510 X |
| 3,057,241 | 10/1962 | Chambon | 83/510 |
| 3,182,588 | 5/1965 | Bolliger | 83/510 X |
| 3,857,316 | 12/1974 | Handley | 83/644 |
| 4,122,740 | 10/1978 | Maltby | 83/646 |

FOREIGN PATENT DOCUMENTS

| | | | |
|---|---|---|---|
| 3015913 | 10/1981 | Fed. Rep. of Germany | 83/646 |
| 1201048 | 8/1970 | United Kingdom | 83/644 |

*Primary Examiner*—Frank T. Yost

*Attorney, Agent, or Firm*—Lerner, David, Littenberg, Krumholz & Mentlik

[57] ABSTRACT

The invention concerns a plane die-cutting machine for die-cutting laminar material, of the type comprising a plane punch and an arc-shaped counter punch, which is controlled by moving means pressing the same against a work material inserted between it and the punch, said counter punch being simultaneously rotated around a line of instant-contact which runs along the punch. To avoid impacts between the reciprocally moving parts, the invention provides extensions integral to the punch and to the counter-punch, which maintain the contact between these latter for a portion of the reciprocal oscillatory movement outside the die-cutting area, so that said reciprocal oscillatory movement takes place with constantly contacting zones, like a blotter of blotting-paper. The die-cutting area is defined in such a way that, when the reciprocally moving parts contact themselves at the ends of said extensions, between the die-cutting parts a hollow space is left, which is sufficient for the passage of the laminar material under work.

7 Claims, 5 Drawing Figures

PLANE DIE-CUTTING MACHINE

This is a continuation of application Ser. No. 348,510 filed Feb. 12, 1982, now abandoned.

BACKGROUND OF THE INVENTION

1. Field of the Invention

This invention concerns a plane die-cutting machine, suitable for die-cutting laminar material and comprising a plane punch which may be equipped with protruding dei-cutting blades and/or points, as well as arch-shaped counter-punch, which is controlled in such a way to be pressed against laminar work material inserted between the same and the punch and to be simultaneously rotated around a line of instant-contact which runs along the punch.

2. Description of the Prior Art

A die-cutting machine of the above mentioned type is disclosed, for example, in U.S. Pat. No. 4,328,729, of the same applicant. In comparison to the machines with both plane punch and counter punch, this equipment has the advantage to reduce the instant contact surface to a theoretically linear area, so that the die-cutting operation can be carried out with a considerably lower force than that required in conventional die-cutting machines. This die-cutting machine however may involve some drawbacks, in that the punch and the counter-punch come into contact at the beginning of each cycle, in a way that sometimes can be violent and similar to an impact.

SUMMARY OF THE INVENTION

An object of this invention is therefore to provide a plane die-cutting machine, which works according to the base principales of the above mentioned die-cutting machine, but wherein any impact contact between the reciprocally moving parts of same is avoided, though ensuring a maximum of precision and reliability in the die-cutting operation and moreover allowing the best conditions of insertion and progress of the laminar material under work. Accordingly this invention proposes a plane die-cutting machine of the above defined type, wherein the punch and counter punch carry extensions protruding outside the die-cutting zone; wherein the counter-punch control means carry out a counter-punch alternate oscillatory movement which extends for a given length beyond the die-cutting zone, and wherein said extensions keep their contact also outside the die-cutting zone along said given length.

DESCRIPTION OF THE PREFERRED EMBODIMENT

Figure 1:
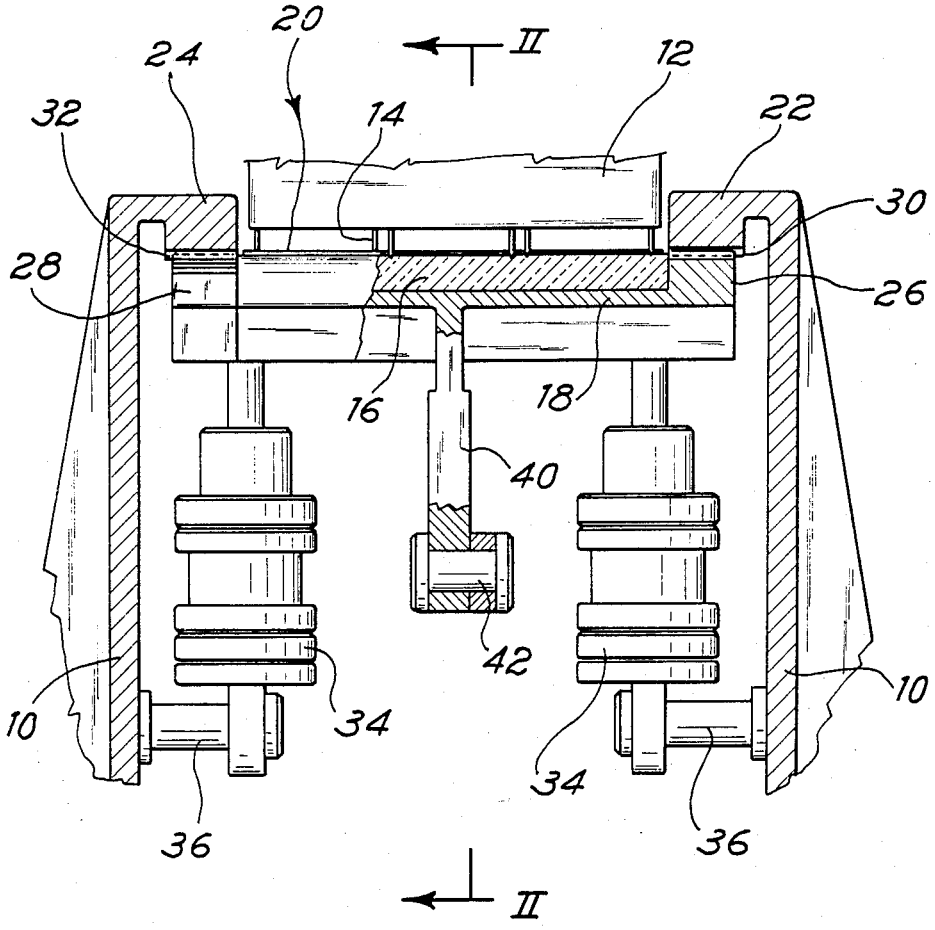
FIG. 1 is a cross-section along a plane perpendicular to that of the laminar material to be die-cut, in correspondence to the central punch zone of a plane die-cutting machine according to the invention.

Referring to the drawings the plane die-cutting machine comprises, in a frame generally indicated by 10, a punch 12 which may be equipped with protruding blades and/or points for die-cutting, as schematically indicated by 14. The configuration of the punch operative elements, their structure and their way to be fixed to the punch 12 and in case to the counter-punch are well known to those skilled in the art and therefore will be not herein described nor specifically illustrated. Said punch 12, 14 is designed to cooperate with a counter-punch 16, which has a configuration with an essentially arc-shaped outline, for instance consisting in a section of a high radius cylindrical surface, said surface being brought into contact with the punch in correspondence to an instantaneous contact line, substantially as described in the above mentioned preceding patent application. Consequently, the counter-punch 16, which is housed in a supporting frame 18, is caused to roll on the punch 12–14, carrying out the die-cutting operation of the laminar material 20 placed between said two elements and each time fed for a length equal to the die-cutting area. In order to prevent the punch and the counter-punch from reciprocally colliding, the invention provides extensions integral to both the punch and the counter-punch respectively. In particular, the punch has on its sides two extensions 22, 24 which extend perpendicularly to the contact line between said two operative elements, essentially on the area where the material to be worked 20 is introduced. Parallely, the counter-punch has two extensions 26 and 28 which extend in correspondence to the extensions 22 and 24, obviously with an arc-shaped configuration corresponding to that of the counter-punch itself. The extensions 22, 26, as well as the extensions 24, 28 are designed to reciprocally act by suitable restraining means which, however, allow the described relative rolling, for instance they carry reciprocally meshing racks 30 and 32.

In this way, on the whole, the counter punch tends to assume the shape of a blotter operating on the plane and fixed punch, with respect to which it carries-out an alternate oscillatory movement which is performed by always keeping a reciprocal contact in correspondence to the extensions 22, 26 and 24, 28, as well as in the central area, in correspondence to the punch 12, 14 and counter-punch 16. When the control means bring the counter-punch near to the ends of its run, that is near to the inversion points in its oscillatory movement, the operative elements 14 and 16 are spaced for a length sufficient to allow the progress between them of the laminar material under work, which obviously has a widening less than the distance between the parallel extensions 22, 24 and 26, 28.

Figure 4:
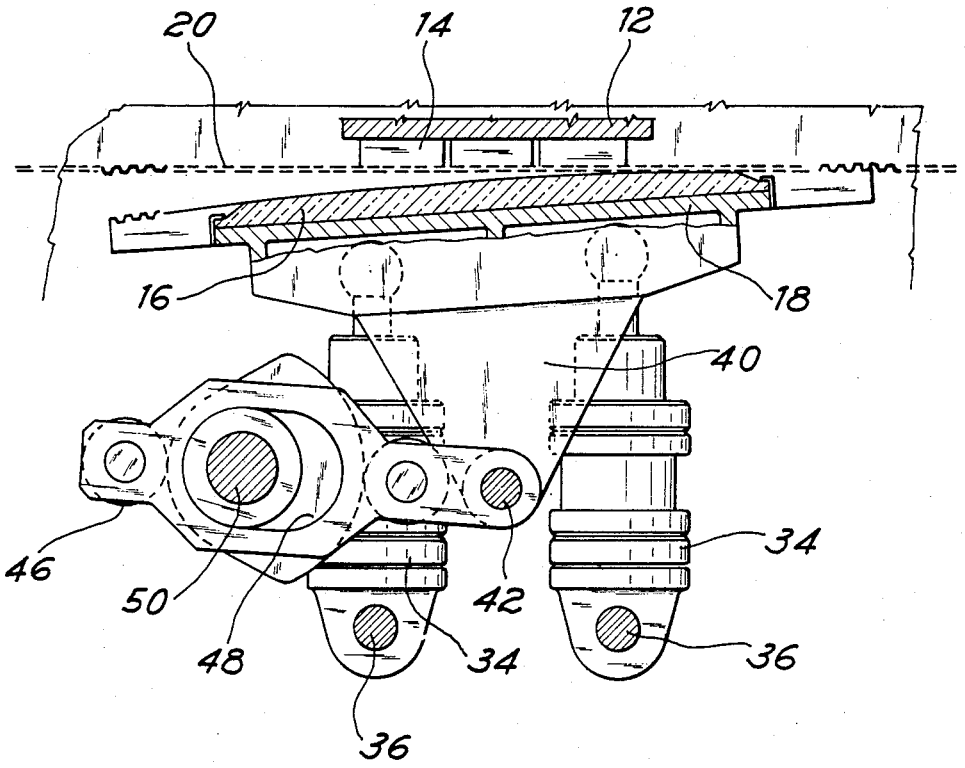
FIG. 4 is a cross-section corresponding to that of the preceding figures and showing the machine at its other end position.
Figure 5:
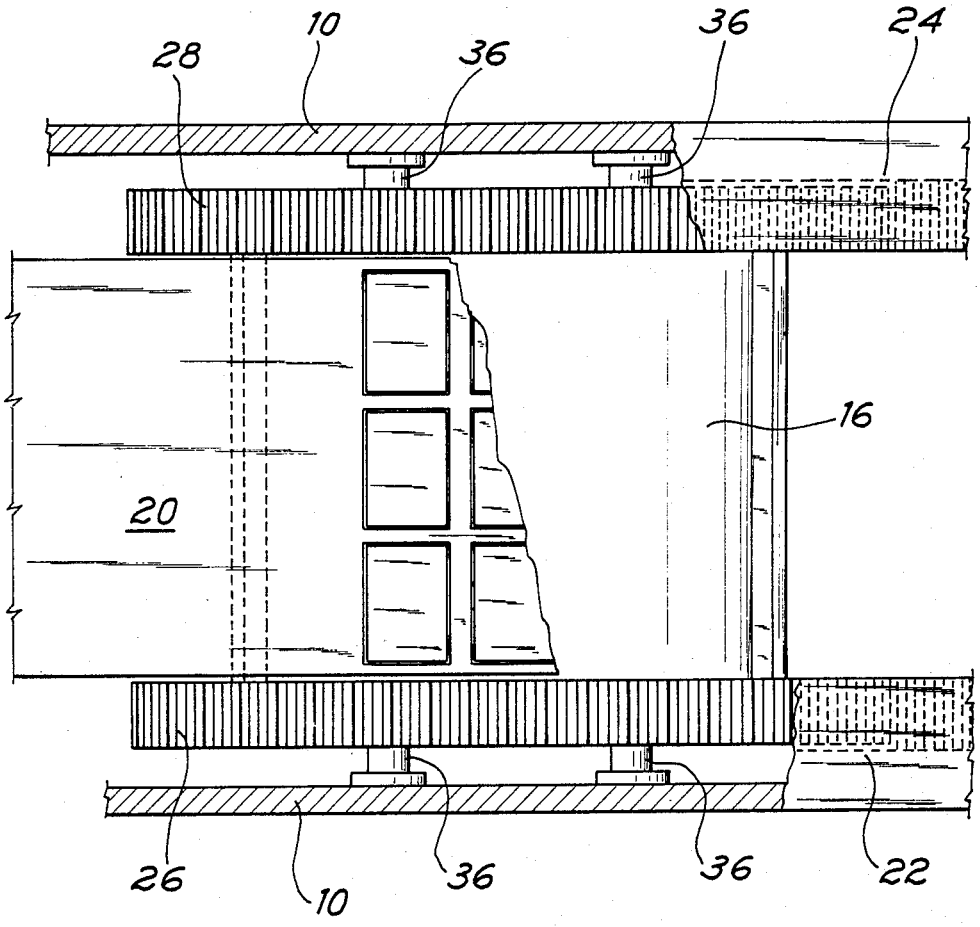
FIG. 5 is a top view, with removed parts, of the machine, as seen according to the cross section V—V of FIG. 2.

Therefore, the operation of the die-cutting machine can take place by performing an operative run at each semi-oscillation, with progress of the material to be worked at the end of each semi-oscillation. Said progress can be carried out by conventional means, both manually and automatically, in the positions as shown in FIGS. 1 and 4.

Figure 2:
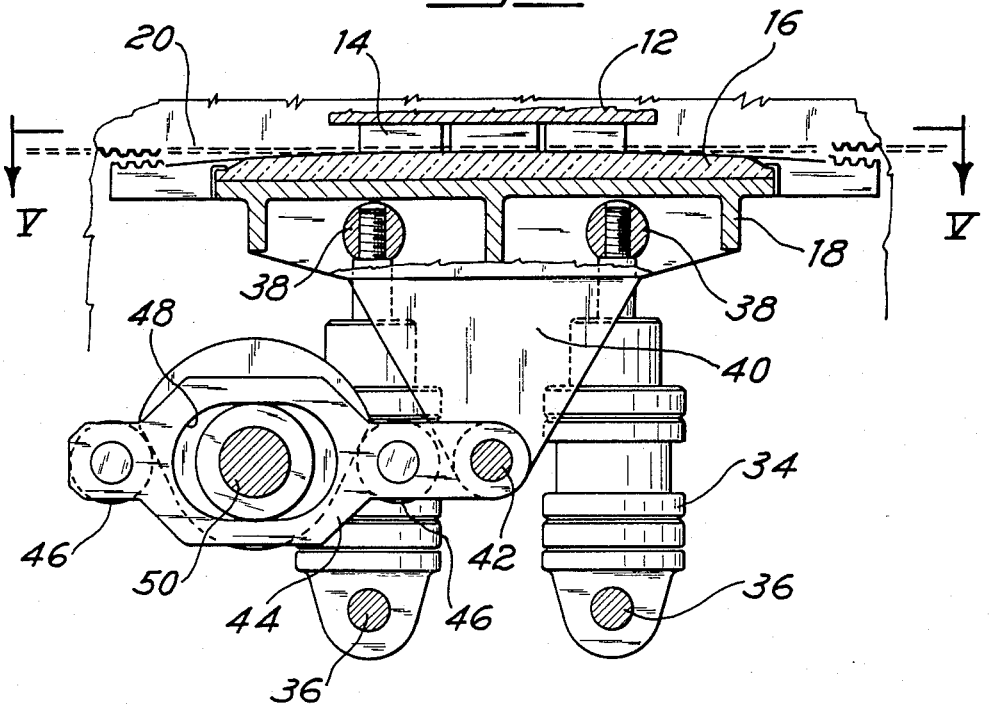
FIG. 2 is a cross-section along the plane II—II of FIG. 1, and diagrammatically showing the machine in its operative condition, at half-way of its die-cutting run.
Figure 3:
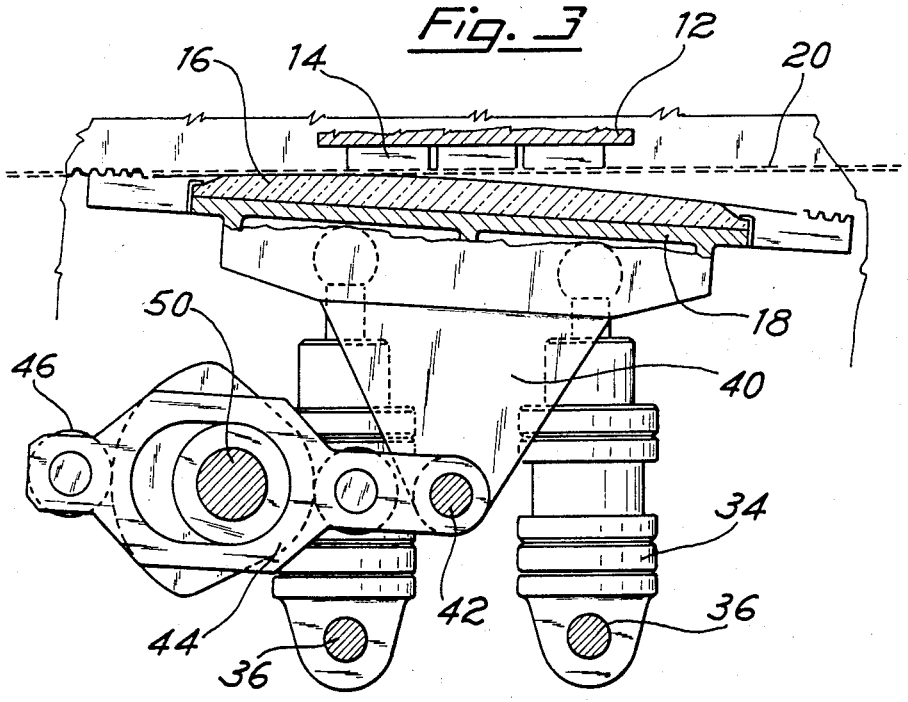
FIG. 3 is a cross section corresponding to that of FIG. 2, and showing the machine in one of its end positions, at the inversion point of the counter-punch oscillatory movement.

The operative movement of the counter-punch 16 may be obtained by two series of elements, acting on the supporting frame 18 and adapted to exert a pressure on the punch 12, 14 and to perform said alternate oscillatory movement. The pressure of the counter-punch on the punch can be exerted thanks to a series of cylinders, for instance four pneumatical cylinders 34 pivoted on one side at 36 to the machine frame 10 acting on the counter-punch through ball joints 38. The support 18 of the counter-punch 16, moreover, shows an appendix 40, which is connected by a pivot 42 to a rod 44 capable to alternatively oscillate said pivot 42 in both directions, between the positions of FIGS. 3 and 4, passing through the position of FIG. 2. For this purpose, the rod 44 is guided by rollers 46, on which an eccentric cam 48 operates, said cam being mounted on an eccentric control shaft 50 which is rotated by means of suitable motor means. The cooperation of said oscillation control means and cylinders 34 allows to obtain the desired movement of counter-punch 16 in an extremely secure and reliable way, without excessive mechanical stress.

What is claimed is:

1. A machine for die-cutting laminar material, said machine comprising a frame, a plane punch having a planar working surface, a counter-punch having an arch shaped working surface movably arranged opposed said working surface of said plane punch, an appendix secured to said counter-punch and extending therefrom, control means for controlling the direction of movement of said counter-punch relative to said plane punch wherein said working surface of said counter-punch contacts said working surface of said plane punch within a die-cutting area along a line of contact extending transversely of said direction of movement of said counter-punch, said line of contact progressively advancing across the working surfaces of said plane punch and said counter-punch by operation of said control means, said control means comprising (1) a cam and cam follower pivotally secured to a portion of said appendix for operating said counter-punch in an alternate oscillatory movement, and (2) a plurality of cylinders each having one end pivotally secured to a portion of said frame, said cylinders each having an extensible end arranged in engagement with said counter-punch whereby said extensible ends of said cylinders cooperate with the oscillatory movement of said counter-punch to maintain said working surface of said plane punch in engagement with said working surface of said counter-punch along said line of contact therebetween as said line of contact progressively advances thereacross, a pair of plane extensions each having a downwardly extending leg terminating at a planar surface and arranged adjacent the sides of said plane punch extending through said die-cutting area along the direction of movement of said counter-punch and extending therebeyond, a pair of counter-extensions each having an upwardly extending leg terminating at an arch shaped surface opposed a respective one of said planar surfaces of said plane extensions and arranged adjacent the sides of said counter-punch extending through said die-cutting area along the direction of movement of said counter-punch and extending therebeyond, and meshing racks having a plurality of gear teeth provided on said planar surfaces of said plane extensions and said arch shaped surfaces of said counter-extensions within said die-cutting area and extending therebeyond, said meshing racks maintaining continuous meshed engagement between said plane extensions and said counter-extensions along progressive opposed portions thereof by the meshing of said plurality of gear teeth of said meshing racks within said die-cutting area and therebeyond during said alternate oscillatory movement of said counter-punch by said cam and cam follower whereby relative movement between said planar shaped working surface of said plane punch and said arch shaped surface of said counter-punch is prevented within said die-cutting area and therebeyond.

2. The machine of claim 1 wherein said plane extensions and said counter-extensions extend beyond said die-cutting area on either side of said plane punch and said counter-punch along said direction of movement of said counter-punch.

3. The machine of claim 1 wherein said plane extensions comprise a pair of U-shaped members.

4. The machine of claim 1 wherein said counter-extensions comprise the legs of a U-shaped member secured to said counter-punch.

5. The machine of claim 1 wherein said direction of movement of said counter-punch relative to said plane punch is oscillatory in movement.

6. The machine of claim 1 wherein said extensible ends of said cylinders include a ball joint in contact with said counter-punch.

7. The machine of claim 1 wherein said direction of movement of said counter-punch by said control means causes the working surfaces of said counter-punch and said plane punch to progressively separate in a direction extending away from said line of contact between said working surfaces such that a sheet of laminar material may be inserted between said working surfaces without interference from said plane punch and said counter-punch.

* * * * *